United States Patent [19]

Tietjens et al.

[11] 4,261,101

[45] Apr. 14, 1981

[54] SHAVING APPARATUS WITH LEAD CUTTER

[75] Inventors: Eduard W. Tietjens; Ferdinand M. Trees, both of Drachten, Netherlands

[73] Assignee: U.S. Philips Corporation, New York, N.Y.

[21] Appl. No.: 946,563

[22] Filed: Sep. 28, 1978

[30] Foreign Application Priority Data

Nov. 28, 1977 [NL] Netherlands ..... 7713047

[51] Int. Cl.[3] ..... B26B 19/64

[52] U.S. Cl. ..... 30/43.92; 30/346.51

[58] Field of Search ..... 30/34.2, 43.4–43.92, 30/346.51; 76/104 R

[56] References Cited

U.S. PATENT DOCUMENTS

| | | | |
|---|---|---|---|
| 3,088,205 | 5/1963 | Ellis | 30/43.6 X |
| 3,962,784 | 6/1976 | Titejens | 30/346.51 X |
| 3,967,374 | 7/1976 | Boiten | 30/43.92 |
| 4,151,645 | 5/1979 | Tietjens | 30/346.51 X |

*Primary Examiner*—Gary L. Smith

*Attorney, Agent, or Firm*—T. A. Briody; W. J. Streeter; R. E. Schneider

[57] ABSTRACT

A shaving apparatus comprising a shear plate and an associated reciprocatory cutting member is provided with cutting elements each having a frusto-conical cross section and being in contact along its base with the shear plate, the opposite sloping sides of a cutting element each forming a guide face. A plurality of individual lead cutters is movable relative to an associated guide face, with such plurality of lead cutters being arranged in side-by-side relationship and engaging the guide face. The lead cutters respectively engaging opposite guide faces are disposed in pairs. Each lead cutter moreover is elastically loaded in the direction of the shear plate.

2 Claims, 7 Drawing Figures

SHAVING APPARATUS WITH LEAD CUTTER

This invention relates to a shaving apparatus having a shear plate with hair-entrance apertures and a cutting member which is reciprocatory relative to the shear plate, which cutting member is provided with cutting elements and lead cutters which are movable relative to the cutting elements.

Such a shaving apparatus is for example known from U.S. Pat. No. 3,088,205. In the construction described in said U.S. patent a hair which is caught in a hair-entrance aperture is pushed away by the lead cutter in the direction of movement of the cutting member. As a result of this the hair assumes a position which is unfavorable for cutting.

It is the object of the present invention to improve the action of a shaving apparatus as described above and this leads to a construction which is characterized in that the lead cutters can perform a movement which is substantially directed away from the shear plate along guide faces of the cutting elements which are inclined relative to the shear plate.

The hairs are pulled inwards by the lead cutters in a movement which is also substantially directed away from the shear plate, which is the most effective direction for the object in view, i.e. to obtain the closest possible shave. Moreover, the hairs are then oriented in this direction and thus assume the most favourable position for cutting.

A preferred embodiment is characterized in that a cutting element is provided with a plurality of lead cutters which are combined into one body. A further elaboration of this is characterized in that the lead cutters of a plurality of cutting elements constitute one unit of elastic foil.

The invention will now be described in detail with reference to the accompanying drawings, in which.

Figure 1:
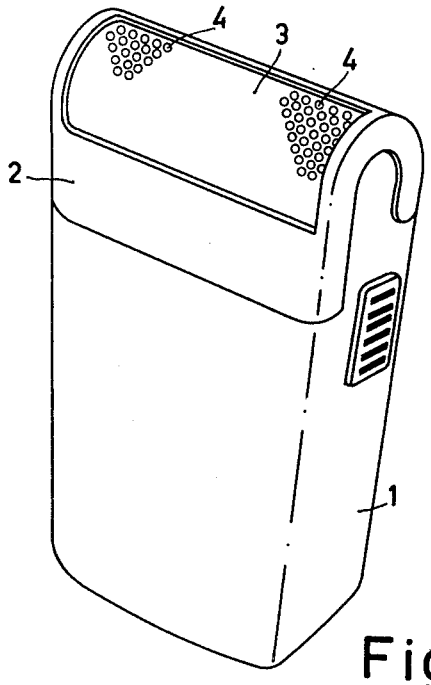
FIG. 1 shows a shaving apparatus in perspective.
Figure 2:
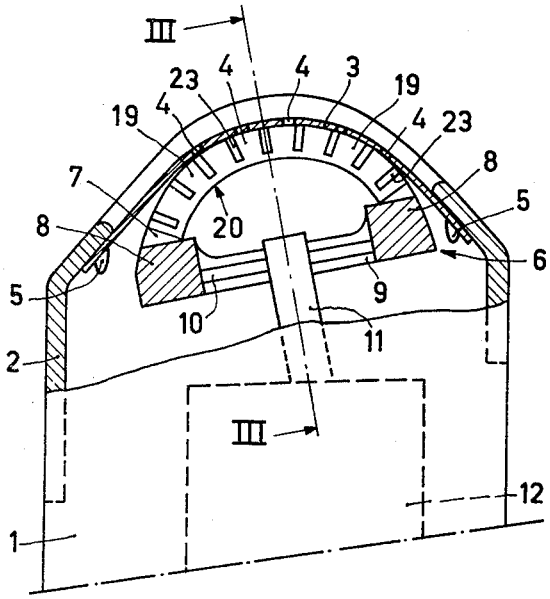
FIG. 2 shows on an enlarged scale the shaving apparatus of FIG. 1, partly in side view and partly in cross-section.
Figure 3:
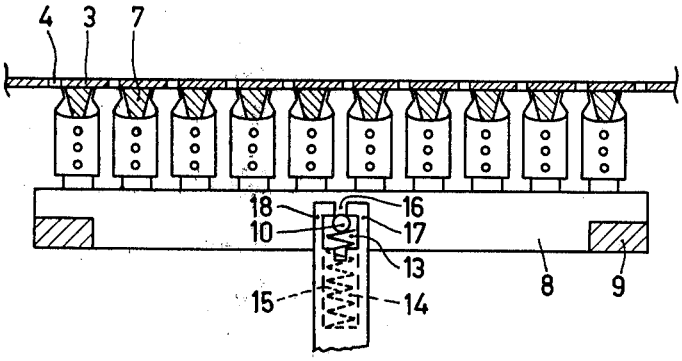
FIG. 3 is a cross-section on a still larger scale taken on the line III—III in FIG. 2.

The shaving apparatus in accordance with FIGS. 1 and 2 comprises a housing 1 with a detachable shaving head 2. The shaving head 2 is provided with a shear plate 3 with hair entrance apertures 4. For the fixation of the shear plate 3 to the shaving head 2 this head is provided with hook-shaped projections 5 which engage with corresponding openings in the shear plate. On the inner side of the shear plate there is disposed a cutting member 6 which is reciprocatory relative to the shear plate. The cutting member 6 is provided with arcuated cutting elements 7 of trapezoidal cross-section (FIG. 3). At their ends the cutting elements 7 are secured to strips 8. These strips 8 are interconnected at their ends by the cross-pieces 9, so that a frame is formed which is the basis of the cutting member. This frame 8, 9 is provided with a pin 10 for coupling the cutting member 6 to the vibrator motor 12 via the drive spindle 11. In the assembled condition the pin 10 engages with the slot 13 at the end of the spindle 11. The cavity 14 in the spindle 11 contains a pressure spring 15, which is tensioned between the spindle 11 and the pin 10, so that the cutting member 6 is urged against the inner side of the shear plate 3.

The slot 16 enables the ends 17 and 18 of the spindle 11 to move apart elastically, if for example manual force is exerted on the cutting member in the longitudinal direction of the spindle 11. The pin 10 can then pass through the slot 16, so that the cutting member 6 can be mounted or removed in a simple manner.

Figure 4:
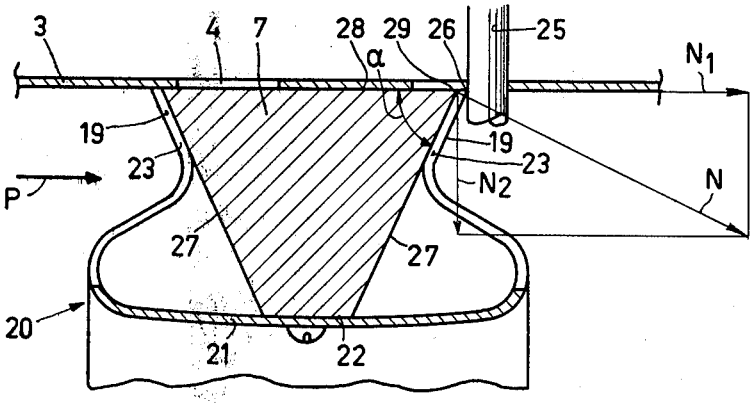
FIGS. 4 and 5 show a detail of the cross-section of FIG. 3 on an enlarged scale.

The arcuated cutting elements 7 (also see FIGS. 4 and 5) are provided with lead cutters 19 on both sides. These lead cutters 19 are parts of a body 20 of elastic foil, which comprises central portion 21 which is for example fixed to the wall 22 of the cutting element by spot-welding. The lead cutters 19 are constituted by cut-outs 23 in the body 20. Owing to the curved portion 24 by which the lead cutters 19 are connected to the central portion 21, the lead cutters are elastically movable relative to the associated cutting element. The operation of the embodiment described in the foregoing is as follows. When a hair 25 is caught in a hair-entrance aperture 4 said hair will soon come into contact with the sharp edge 26 of a lead cutter 19 owing to the reciprocating movement of the cutting member 6. The sharp edge 26 will slightly penetrate the hair, but without cutting off the hair. The reaction force which is exerted on the lead cutter 19 by the hair 25 will generally be directed oppositely to the direction of movement P. This force is compensated for by the component $N_1$ of the normal force N which is exerted on the lead cutter by the guide face 27 of the cutting element 7, which face is inclined relative to the shear plate 3 (FIG. 4). For the sake of simplicity the small frictional forces between the lead cutter and the cutting elements have been neglected. The component $N_2$ of the normal force N will cause the lead cutter 19 to slide along the guide face 27 in a movement whose direction is substantially transverse to the shear plate. The angle $\alpha$ between the guide face 27 and the plane 28 of the cutting element 7 which engages with the shear plate 3 should then be smaller than 90°.

Figure 5:
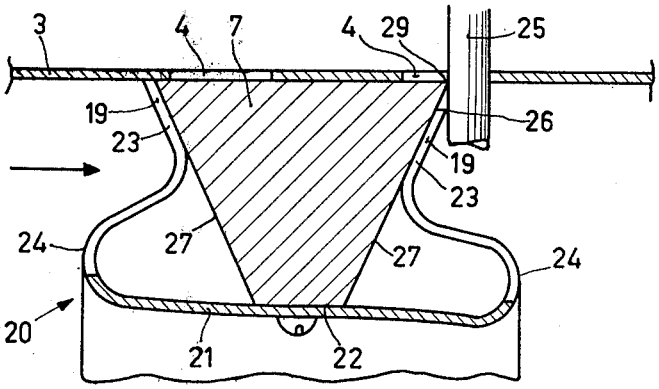

The hair 25 will be moved along by the lead cutter 19 until the cutting edge 29 of the cutting element has reached the hair (FIG. 5). Subsequently, the hair will be cut off by cooperation of the shear plate 3 and the cutting element 7. Thus, the hairs are cut more closely and a better shaving result is obtained than in a similar shaving apparatus without lead cutters.

The displacement of the lead cutter relative to the shear plate is the sum of the relative displacement of the lead cutter with respect to the cutting element and the displacement of the lead cutter together with the cutting member in the direction of movement P. In the situation of FIGS. 4 and 5 the lead cutter has moved in a direction normal to the shear plate. Generally, the movement will be directed substantially away from the shear plate and towards the interior of the apparatus, so that the action of the lead cutter is most effective. Moreover, the lead cutter will bring the hairs which are positioned obliquely relative to the shear plate into a position which more closely approximates a position normal to the shear plate, which is more favourable for cutting.

The inclined guide faces 27 on both sides of a cutting element 7 take the form of a part of a conical surface. By employing a plurality of lead cutters 19 of small width on each side of a cutting element 7 the part of the guide face 27 facing a lead cutter may be regarded as an approximately plane surface.

Figure 6:
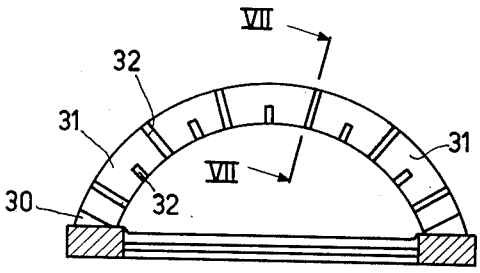
FIG. 6 shows a cross-section of a variant of the cutting member.
Figure 7:
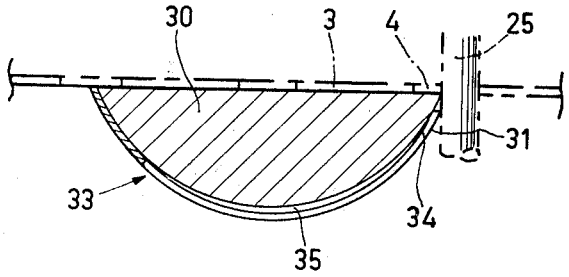
FIG. 7 shows a cross-section on an enlarged scale taken on the line VII—VII in FIG. 6.

The embodiment of FIGS. 6 and 7 concerns a variant of the cutting member of FIGS. 2 through 5 and components which have not been modified bear the same reference numerals. In cross-section the cutting element 30 is a circular segment and the lead cutters 31 are formed by cut-outs 32 in a body 33 of elastic foil. These cut-outs may for example be staggered relative to each other on both sides of the cutting element 30.

The lead cutter 31 initially engages with the cutting element 30, but upon contact with a hair the lead cutter will move along the guide face 34, so that a clearance 35 is formed between the lead cutter and the cutting element (FIG. 7).

In both embodiments described in the foregoing, the bodies 20, 33 of elastic foil of the various cutting elements may form one unit which be bodily mounted onto or removed from the cutting member.

In order to prevent collection of dirt between the lead cutter and the cutting member the construction should preferably be such that in the rest condition, for example, when the apparatus is not in use, the lead cutter 19, 31 is already tightened against the associated guide face 27, 34 and is consequently positioned against said guide face with some force.

What is claimed is:

1. A shaving apparatus comprising a shear plate with hair-entrance apertures; a cutting member associated with and reciprocatory relative to the shear plate; cutting elements extending from said cutting member toward the shear plate, each cutting element having a frusto-conical cross section and being in contact along its base with the shear plate, the opposite sloping sides of said cutting element each forming a guide face; and a plurality of individual lead cutters respectively associated with and movable relative to a guide face of a cutting element, each plurality of lead cutters being arranged in side-by-side relationship and engaging its respective guide face, the lead cutters respectively engaging the opposite guide faces of a cutting element being disposed in pairs, each lead cutter also normally being in contact with the shear plate, and each lead cutter being elastically loaded in the direction of the shear plate.

2. A shaving apparatus according to claim 1, in which the two pluralities of lead cutters associated with each cutting element together comprise a unitary structure.

* * * * *